US008876111B1

(12) United States Patent
Lan

(10) Patent No.: US 8,876,111 B1
(45) Date of Patent: Nov. 4, 2014

(54) INVERTING ROLLER DEVICE FOR CONVEYING PAPER AND METHOD FOR CHANGING CONVEYING PATH OF PAPER

(71) Applicant: Primax Electronics Ltd., Taipei (TW)

(72) Inventor: Chia-Tsui Lan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 14/019,078

(22) Filed: Sep. 5, 2013

(30) Foreign Application Priority Data

Apr. 11, 2013 (CN) ..... 2013 1 0125435

(51) Int. Cl.

| | |
|---|---|
| ***B65H 39/10*** | (2006.01) |
| ***B65H 5/06*** | (2006.01) |
| ***B65H 5/26*** | (2006.01) |
| ***B65H 7/20*** | (2006.01) |

(52) U.S. Cl.
CPC .. *B65H 5/26* (2013.01); *B65H 5/06* (2013.01); *B65H 7/20* (2013.01)
USPC ..... 271/304; 271/273; 271/274; 271/303

(58) Field of Classification Search
CPC ..... B65H 5/062; B65H 2511/224; B65H 2404/143; B65H 2404/144; B65H 2404/1441; B65H 29/58; B65H 29/60
USPC ..... 271/272–274, 3.03, 3.04, 303, 304
See application file for complete search history.

(56) References Cited

U.S. PATENT DOCUMENTS

| | | | | |
|---|---|---|---|---|
| 4,256,299 | A * | 3/1981 | Hogenson | 271/262 |
| 5,183,249 | A * | 2/1993 | Ichikawa | 271/186 |
| 6,186,501 | B1 * | 2/2001 | St. Ours | 271/302 |
| 7,654,524 | B2 * | 2/2010 | Thomson | 271/262 |
| 8,579,287 | B1 * | 11/2013 | Herrmann et al. | 271/302 |
| 2009/0250868 | A1 * | 10/2009 | Tsai et al. | 271/226 |

FOREIGN PATENT DOCUMENTS

| | | | | |
|---|---|---|---|---|
| JP | 02300058 | A * | 12/1990 | B65H 29/20 |
| JP | 04012950 | A * | 1/1992 | B65H 5/06 |

* cited by examiner

*Primary Examiner* — Prasad Gokhale
(74) *Attorney, Agent, or Firm* — Kirton McConkie; Evan R. Witt

(57) ABSTRACT

An inverting roller device is used for changing a conveying path of a paper. The inverting roller device includes a first rotating shaft, a first roller, a second rotating shaft, a second roller, and a first swinging arm. The first roller and the second roller are disposed on the first rotating shaft and the second rotating shaft, respectively. The first swinging arm is pivotally disposed on the first rotating shaft and connected with the second rotating shaft. First, the first roller and the second roller are rotated to allow the paper to be moved in a first traveling direction. Then, the rotation of the first roller is temporarily stopped, and the second rotating shaft and the second roller are driven by the first swinging arm to be moved relative to a surface of the first roller. Consequently, the conveying path of the paper is changed.

8 Claims, 11 Drawing Sheets

INVERTING ROLLER DEVICE FOR CONVEYING PAPER AND METHOD FOR CHANGING CONVEYING PATH OF PAPER

FIELD OF THE INVENTION

The present invention relates to an inverting roller device, and more particularly to an inverting roller device for changing a conveying path of a paper.

BACKGROUND OF THE INVENTION

An image forming apparatus such as a scanning apparatus or a printing apparatus is usually equipped with a mechanism for changing a conveying path of a paper. For example, if the image forming apparatus needs to perform a duplex scanning operation or a duplex printing operation on the paper, the paper should be moved to different conveying paths. Hereinafter, some conventional image forming apparatuses and associated methods for changing the conveying path of the paper will be illustrated in more details.

First of all, a first conventional image forming apparatus 1 will be illustrated with reference to FIG. 1. FIG. 1 is a schematic cross-sectional side view illustrating a first conventional image forming apparatus. As shown in FIG. 1, the image forming apparatus 1 comprises at least one paper 11, an input tray 12, a pick-up roller 13, a feed roller assembly 14, an optical photoconductive drum 15, a fusing roller assembly 17, a first conveying roller assembly 18, a movable stopping block 19, a second conveying roller assembly 20, a third conveying roller assembly 21, a fourth conveying roller assembly 22, a scanning unit 23, a reflective mirror 24, and an ejecting roller 25.

A process of conveying the paper 11 by the image forming apparatus 1 will be illustrated in more details as follows. Firstly, the paper 11 on the input tray 12 is transported by the pick-up roller 13, and thus the paper 11 is moved in the direction toward the feed roller assembly 14. Then, by the feed roller assembly 14, the paper 11 is controlled to be moved across the optical photoconductive drum 15. Consequently, an image formed on the optical photoconductive drum 15 is transferred onto a first surface of the paper 11.

As the paper 11 is continuously moved and transported across the fusing roller assembly 17, the image which is transferred to the first surface of the paper 11 can be firmly adsorbed onto the paper 11. Then, the paper 11 is transported by the first conveying roller assembly 18, and thus the paper 11 is moved in the direction toward the movable stopping block 19.

For performing a duplex printing task, the movable stopping block 19 is switched to the position which is indicated as solid lines (see FIG. 1). Under this circumstance, since the paper 11 is stopped by the movable stopping block 19, the paper 11 is allowed to be moved in the direction toward the second conveying roller assembly 20 (i.e. along the path A). Then, the paper 11 is transported by the second conveying roller assembly 20, and thus the paper 11 is moved in the direction away from the first conveying roller assembly 18.

When a tail edge of the paper 11 is moved across a protruding corner 261 of a supporting plate 26 along the path A, the rotating direction of the second conveying roller assembly 20 is changed. Consequently, the paper 11 is moved along the path C, and sequentially moved across the third conveying roller assembly 21, the fourth conveying roller assembly 22 and the feed roller assembly 14. Then, by the feed roller assembly 14, the paper 11 is controlled to be moved across the optical photoconductive drum 15 again. Consequently, an image formed on the optical photoconductive drum 15 is transferred onto a second surface of the paper 11.

Meanwhile, the movable stopping block 19 is switched to the position which is indicated as dotted lines (see FIG. 1). Consequently, the paper 11 is sequentially moved through the fusing roller assembly 17 and the first conveying roller assembly 18. Under this circumstance, since the paper 11 is stopped by the movable stopping block 19, the paper 11 is allowed to be moved in the direction toward the ejecting roller 25 (i.e. along the path B). Afterwards, the paper 11 is outputted to an outlet tray 27 of the image forming apparatus 1. At this moment, the task of conveying the paper 11 by the image forming apparatus 1 is completed.

Hereinafter, a second conventional image forming apparatus 3 will be illustrated with reference to FIGS. 2 and 3. FIG. 2 is a schematic cross-sectional side view illustrating a second conventional image forming apparatus. FIG. 3 is another schematic cross-sectional side view illustrating the second conventional image forming apparatus of FIG. 2. As shown in FIGS. 2 and 3, the image forming apparatus 3 comprises a pick-up arm 31, a first conveying roller assembly 32, a second conveying roller assembly 33, a third conveying roller 34, a fourth conveying roller 35, a fifth conveying roller 36, and a movable stopping block 37.

A process of conveying a paper 30 by the image forming apparatus 3 will be illustrated in more details as follows. Firstly, the paper 30 is transported by the pick-up arm 31, and thus the paper 30 is moved in the direction toward the first conveying roller assembly 32 along a path B'. Then, by the first conveying roller assembly 32, the paper 30 is transported to a region between the third conveying roller 34 and the fourth conveying roller 35. Before the paper 30 is contacted with the third conveying roller 34 and the fourth conveying roller 35, the paper 30 is moved across a scan region D. Consequently, a scanning operation is performed on a first surface of the paper 30.

During the scanning operation is performed on the first surface of the paper 30, the movable stopping block 37 is located at the position as shown in FIG. 2. Consequently, the paper 30 is clamped and transported by the third conveying roller 34 and the fourth conveying roller 35, and the paper 30 is moved in the direction toward the second conveying roller assembly 33.

After the paper 30 is moved for a specified distance in the direction away from the third conveying roller 34 by the second conveying roller assembly 33, the movable stopping block 37 is switched to the position as shown in FIG. 3. In addition, the rotating direction of the second conveying roller assembly 33 is changed. Consequently, the paper 30 is moved along the path C', transported through a region between the fourth conveying roller 35 and the fifth conveying roller 36, and moved in the direction toward the first conveying roller assembly 32. The paper 30 is moved across the scan region D again, and thus a scanning operation is performed on a second surface of the paper 30.

However, the image forming apparatus 1 and the image forming apparatus 3 still have some drawbacks. For example, it is necessary to additionally install the movable stopping block 19 or 37 in the image forming apparatus 1 or 3 in order to switch the conveying path of the paper. Since the movable stopping block 19 or 37 requires a large layout space, the overall volume of the image forming apparatus 1 or 3 will be increased. Moreover, if the moving paper collides with the movable stopping block 19 or 37, the possibility of damaging or bending the paper will be increased.

Therefore, there is a need of providing a device and a method for changing a conveying path of the paper in order to overcome the above drawbacks.

SUMMARY OF THE INVENTION

The present invention provides an inverting roller device for conveying a paper and a method of using the inverting roller device to switch a conveying path of the paper.

In accordance with an aspect of the present invention, there is provided an inverting roller device for conveying a paper and changing a conveying path of the paper. The inverting roller device includes a first rotating shaft, a first roller, a second rotating shaft, a second roller, a first swinging arm, and a second swinging arm. The first rotating shaft includes a protrusion part. When the first rotating shaft is in a positively-driven state, the first rotating shaft is rotated in a first rotating direction. When the first rotating shaft is in a reversely-driven state, the first rotating shaft is rotated in a second rotating direction. The first roller is pivotally disposed on the first rotating shaft, and includes a notch. The notch includes a first sidewall and a second sidewall. The protrusion part is accommodated within the notch. The second rotating shaft is located at a side of the first rotating shaft and arranged in parallel with the first rotating shaft. The second roller is disposed on the second rotating shaft. The first roller and the second roller are contacted with each other, so that the paper is clamped and conveyed by the first roller and the second roller. The first swinging arm is pivotally disposed on a first end of the first rotating shaft and connected with a first end of the second rotating shaft. As the first rotating shaft is rotated, the first swinging arm is correspondingly rotated. The second swinging arm is disposed on a second end of the first rotating shaft and connected with a second end of the second rotating shaft. When the first rotating shaft is in the positively-driven state, the protrusion part is contacted with the first sidewall of the notch, so that the first roller is synchronously rotated with the first rotating shaft. When the first rotating shaft is switched from the positively-driven state to the reversely-driven state, the protrusion part is separated from the first sidewall of the notch and moved toward the second sidewall of the notch, so that the first roller is not rotated temporarily and the first swinging arm is driven by the first rotating shaft to be rotated. As the first swinging arm is rotated, the second rotating shaft and the second roller are moved relative to a surface of the first roller, so that a relative position between the first roller and the second roller is changed and the conveying path of the paper is correspondingly changed.

In accordance with another aspect of the present invention, there is provided an inverting roller device for conveying a paper and changing a conveying path of the paper. The inverting roller device includes a first rotating shaft, a first roller, a second rotating shaft, a second roller, a first swinging arm, a second swinging arm, and a power mechanism. The first roller is disposed on the first rotating shaft. The second rotating shaft is located at a side of the first rotating shaft and arranged in parallel with the first rotating shaft. The second roller is disposed on the second rotating shaft. The first roller and the second roller are contacted with each other, so that the paper is clamped and conveyed by the first roller and the second roller. The first swinging arm is pivotally disposed on a first end of the first rotating shaft and connected with a first end of the second rotating shaft. The second swinging arm is disposed on a second end of the first rotating shaft and connected with a second end of the second rotating shaft. The power mechanism is connected with the first swinging arm for driving the first swinging arm to be rotated about the first rotating shaft. When the first rotating shaft is not driven, the first swinging arm is driven by the power mechanism to be rotated, the second rotating shaft and the second roller are moved relative to a surface of the first roller. Consequently, a relative position between the first roller and the second roller is changed and the conveying path of the paper is correspondingly changed.

In accordance with a further aspect of the present invention, there is provided a method for changing a conveying path of a paper. The paper is clamped between a first roller and a second roller and conveyed by the first roller and the second roller. A first rotating shaft is penetrated through the first roller. A second rotating shaft is penetrated through the second roller. The method includes steps of rotating the first roller and the second roller to allow the paper to be conveyed in a first traveling direction, stopping rotating the first roller for a specified time period and allowing the second rotating shaft to be moved relative to a surface of the first roller during the specified time period in order to change relative position between the first roller and the second roller, and rotating the first roller again to allow the paper to be conveyed in a second traveling direction.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
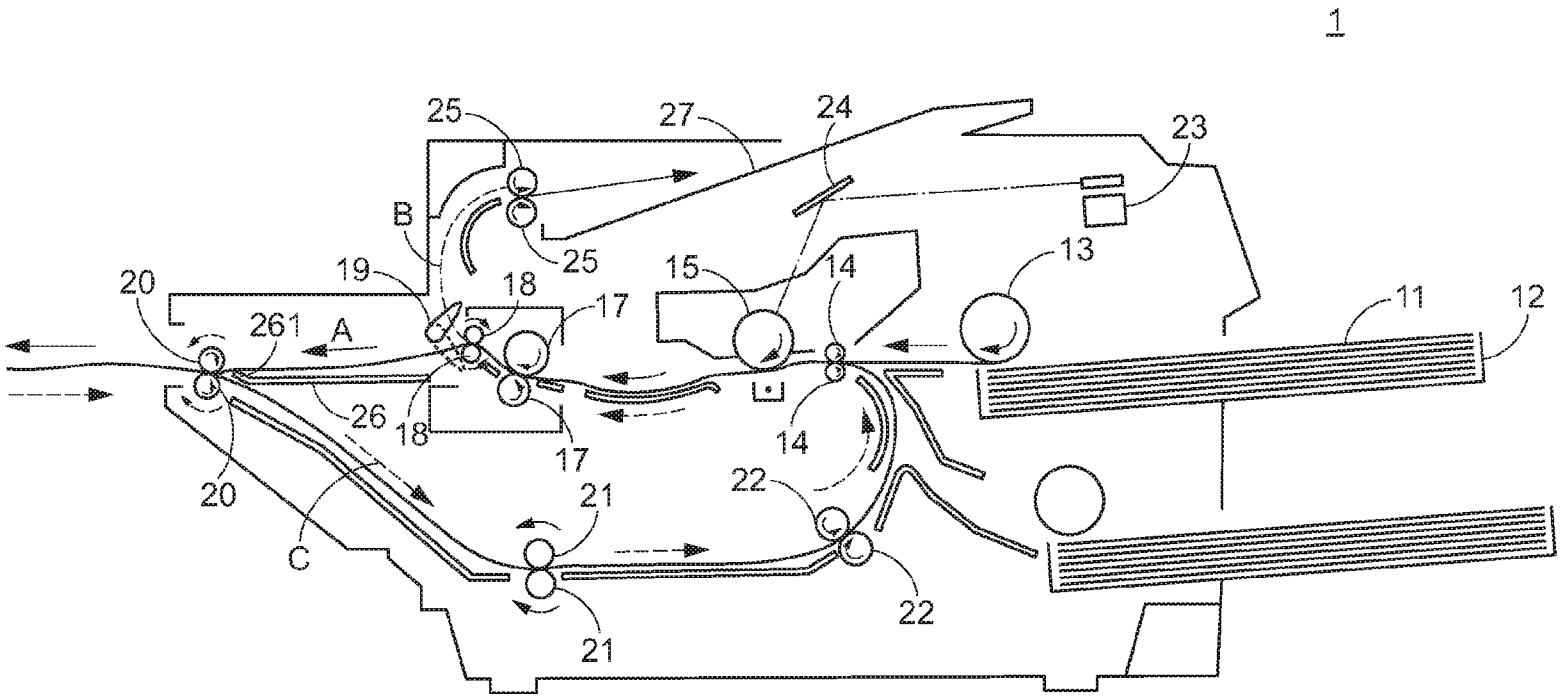
FIG.1 PRIOR ART
FIG. 1 is a schematic cross-sectional side view illustrating a first conventional image forming apparatus.
Figure 2:
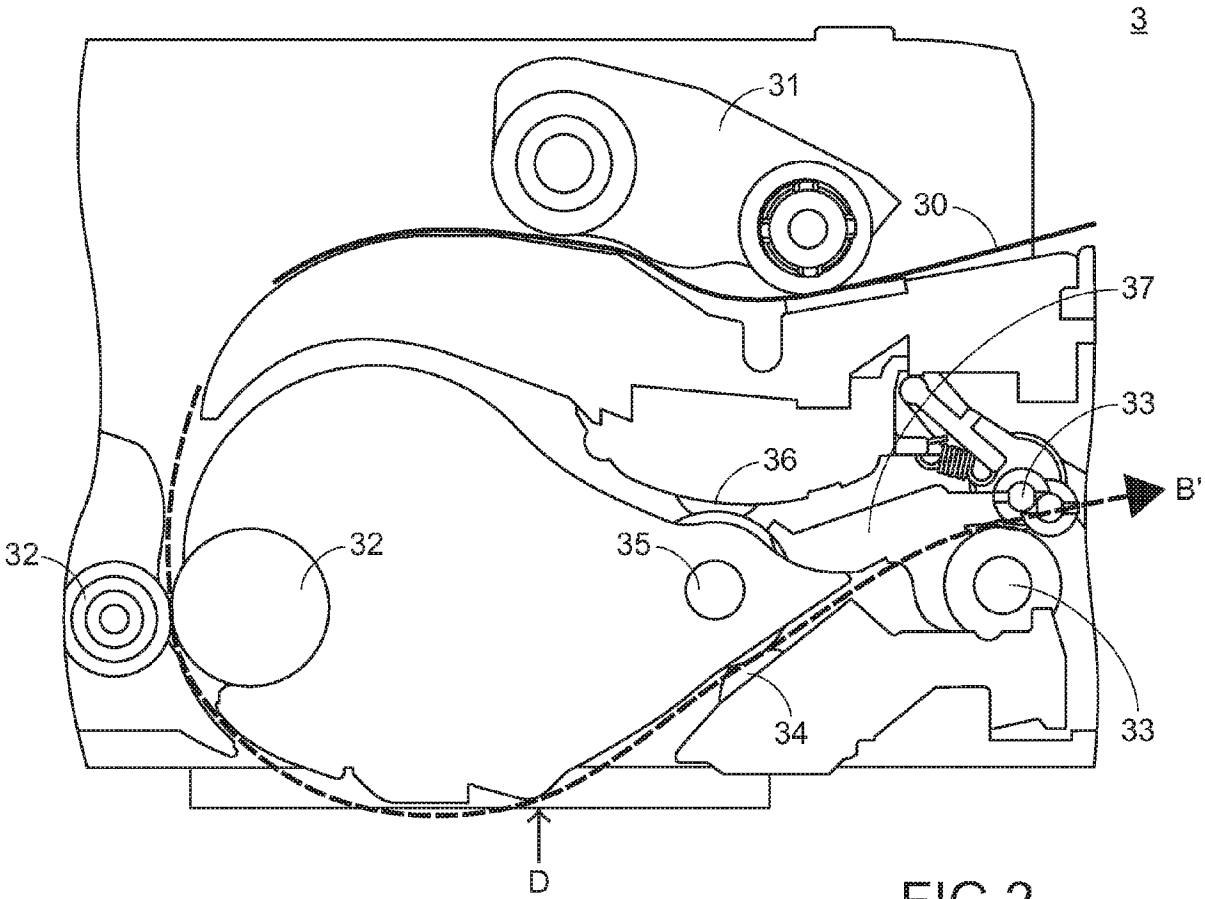
FIG.2 PRIOR ART
FIG. 2 is a schematic cross-sectional side view illustrating a second conventional image forming apparatus.
Figure 3:
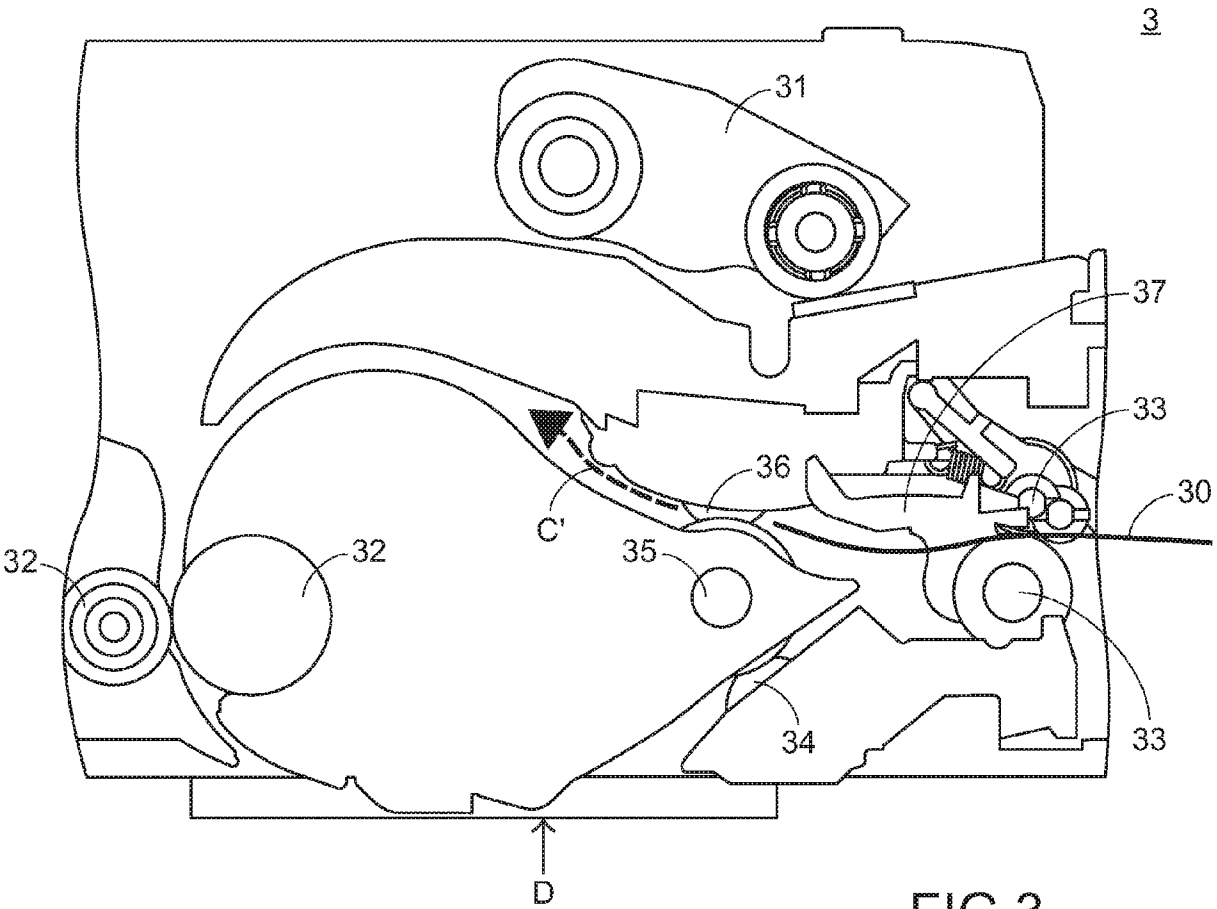
FIG.3 PRIOR ART
FIG. 3 is another schematic cross-sectional side view illustrating the second conventional image forming apparatus of FIG. 2.

In accordance with a first embodiment of the present invention, an inverting roller device 4 (see FIG. 4) for conveying a paper is provided. The inverting roller device 4 is used for changing a conveying path of the paper. The inverting roller device 4 may be applied to the image forming apparatus 1 of FIG. 1 to replace the second conveying roller assembly 20. Alternatively, the inverting roller device 4 may be applied to the image forming apparatus 3 of FIG. 2 to replace the second conveying roller assembly 33. The applications of the inverting roller device 4 are not restricted as as the above described. The inverting roller device 4 may be used in the image forming apparatus to switch the conveying path of the paper. In case that the inverting roller device 4 is applied to the image forming apparatus 1 or the image forming apparatus 3, the movable stopping block 37 may be omitted, and it is not necessary to install the protruding corner 261 of the supporting plate 26 along the path A.

Figure 4:
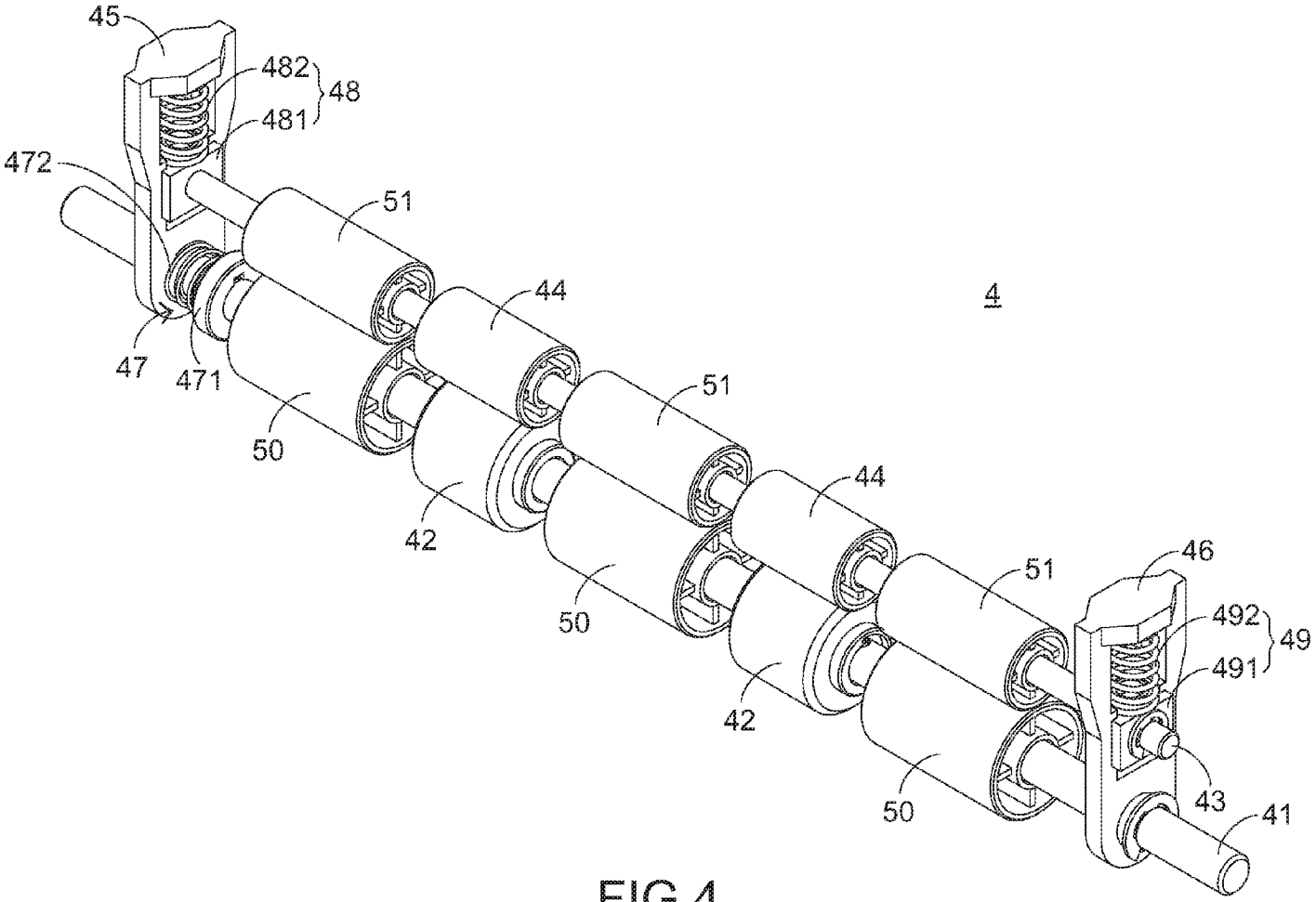
FIG. 4 is a schematic perspective view illustrating the outer appearance of an inverting roller device according to a first embodiment of the present invention.
Figure 5:
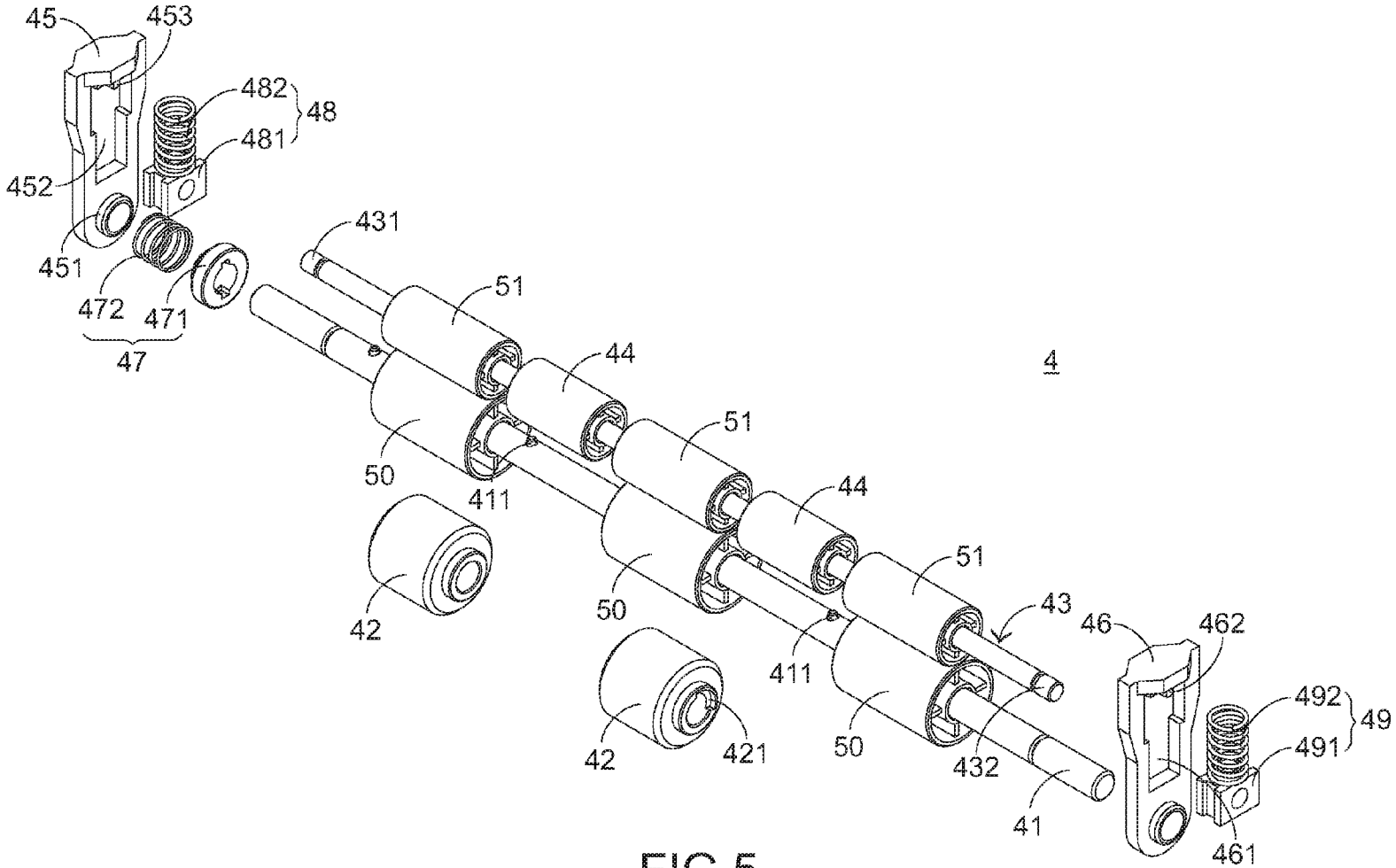
FIG. 5 is a schematic exploded view illustrating the inverting roller device of FIG. 4 and taken along a first viewpoint.
Figure 6:
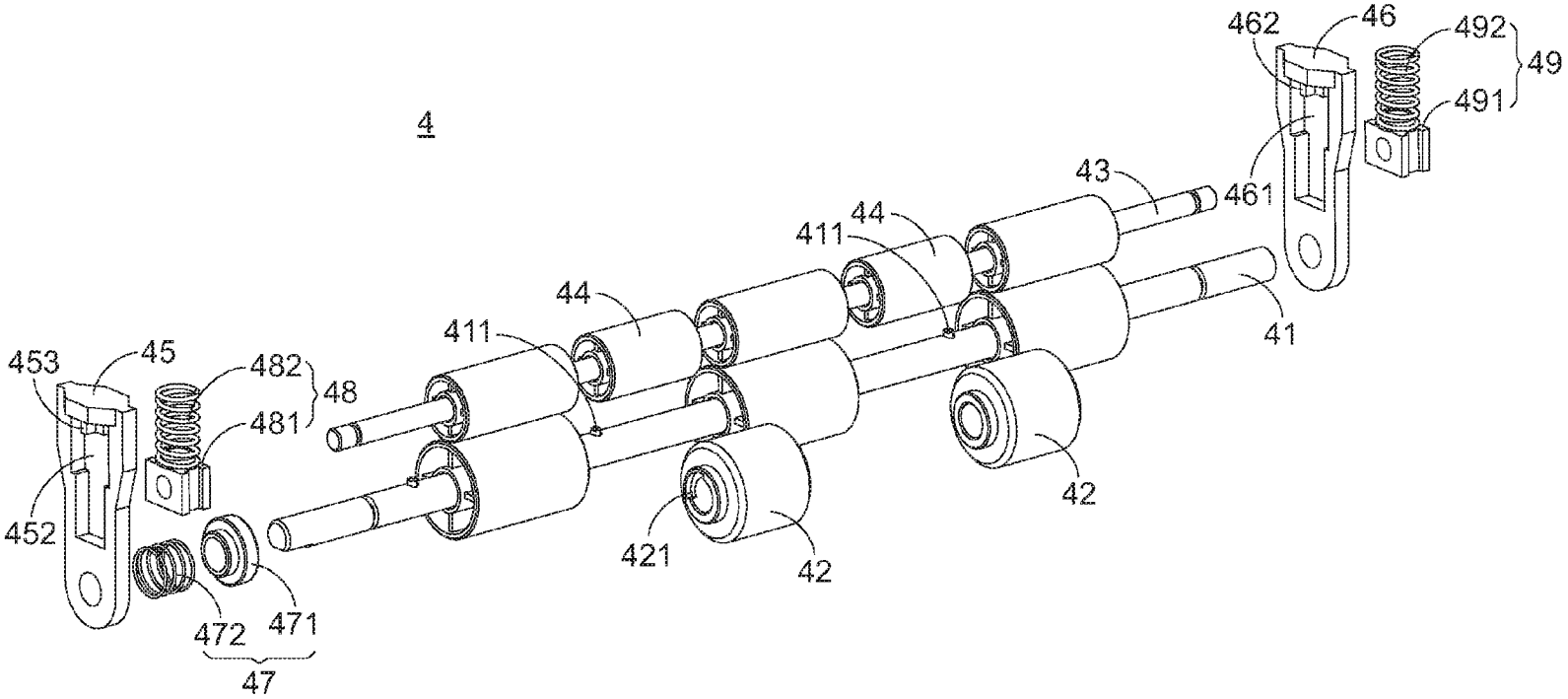
FIG. 6 is a schematic exploded view illustrating the inverting roller device of FIG. 4 and taken along a second viewpoint.

FIG. 4 is a schematic perspective view illustrating the outer appearance of an inverting roller device according to a first embodiment of the present invention. FIG. 5 is a schematic exploded view illustrating the inverting roller device of FIG. 4 and taken along a first viewpoint. FIG. 6 is a schematic exploded view illustrating the inverting roller device of FIG. 4 and taken along a second viewpoint. Please refer to FIGS. 4, 5 and 6. The inverting roller device 4 comprises a first rotating shaft 41, two first rollers 42, a second rotating shaft 43, two second rollers 44, a first swinging arm 45, a second swinging arm 46, a transmission mechanism 47, a first floating mechanism 48, a second floating mechanism 49, three first auxiliary rollers 50, and three second auxiliary rollers 51.

In accordance with the features of the inverting roller device 4, when the first rotating shaft 41 is positively or reversely driven, the first swinging arm 45 is driven by the first rotating shaft 41 to be synchronously rotated with the first rotating shaft 41. Moreover, as the first swinging arm 45 is rotated, the second rotating shaft 43 and the two second rollers 44 are driven to be moved relative to the surfaces of the two first rollers 42. Consequently, the relative positions between the two first rollers 42 and the two second rollers 44 are changed.

A sequence of assembling the inverting roller device 4 will be illustrated in more details as follows. Firstly, the second rotating shaft 43 is located at a side of the first rotating shaft 41 and arranged in parallel with the first rotating shaft 41. The two first rollers 42 and the three first auxiliary rollers 50 are pivotally disposed on the first rotating shaft 41. The two second rollers 44 and the three second auxiliary rollers 51 are disposed on the second rotating shaft 43. Moreover, the two second rollers 44 are contacted with the two first rollers 42, respectively. The three first auxiliary rollers 50 are aligned with the three second auxiliary rollers 51, respectively. The two ends of the first rotating shaft 41 are fixed and fail to be moved. The way of fixing the first rotating shaft 41 is not restricted, and is not redundantly described herein.

It is noted that the structures of the inverting roller device 4 as shown in FIGS. 4, 5 and 6 are presented herein for purpose of illustration and description only. Moreover, the numbers and the shapes of the first rollers 42 and the second rollers 44 are not restricted. For example, the inverting roller device 4 may comprise a single first roller 42 and a single second roller 44. Alternatively, in some other embodiments, the inverting roller device 4 may comprise more than two first rollers 42 and more than two second rollers 44. Moreover, the numbers of the first auxiliary rollers 50 and the second auxiliary rollers 51 are not restricted. Alternatively, in some other embodiments, the first auxiliary rollers 50 and the second auxiliary rollers 51 are not included in the inverting roller device 4.

The first swinging arm 45 and the second swinging arm 46 are pivotally disposed on the two ends of the first rotating shaft 41. Moreover, the first swinging arm 45 and the second swinging arm 46 are connected to the two ends of the second rotating shaft 43 through the first floating mechanism 48 and the second floating mechanism 49, respectively. Moreover, the first swinging arm 45 is in power communication with the first rotating shaft 41 through the transmission mechanism 47. Consequently, as the first rotating shaft 41 is rotated, the first swinging arm 45 is synchronously rotated with the first rotating shaft 41.

When the first swinging arm 45 is synchronously rotated with the first rotating shaft 41, the second rotating shaft 43 and the two second rollers 44 are driven to be moved relative to the surfaces of the two first rollers 42. Moreover, the second swinging arm 46 is also synchronously rotated with the first swinging arm 45. Consequently, the relative positions between the two first rollers 42 and the two second rollers 44 are correspondingly changed.

The connection relationships between the first rotating shaft 41, the two first rollers 42, the second rotating shaft 43, the two second rollers 44, the first swinging arm 45 and the second swinging arm 46 will be illustrated in more details as follows. Firstly, the first rotating shaft 41 comprises two protrusion parts 411. Each of the two first rollers 42 comprises a notch 421. After the first rotating shaft 41 is penetrated through the two first rollers 42, the two protrusion parts 411 are accommodated within the two notches 421, respectively. In an embodiment, the two protrusion parts 411 are additional components that are disposed on the first rotating shaft 41. Alternatively, in some other embodiments, the two protrusion parts 411 are integrally formed with the first rotating shaft 41. The shape of each notch 421 is not restricted as long as the capacity of the notch 421 is larger than the volume of the corresponding protrusion part 411.

Next, the transmission mechanism 47 comprises a rotating wheel 471 and a first elastic element 472. The rotating wheel 471 is fixed on the first rotating shaft 41 and located near the first swinging arm 45. The first elastic element 472 is sheathed around the rotating wheel 471 and a lateral bulge 451 of the first swinging arm 45.

Alternatively, in some other embodiments, the inverting roller device 4 may comprise two transmission mechanisms 47. One of these two transmission mechanisms 47 is connected with the first rotating shaft 41 and the first swinging arm 45, and the other transmission mechanism 47 is connected with the first rotating shaft 41 and the second swinging arm 46. Consequently, the first swinging arm 45 and the second swinging arm 46 are driven by the first rotating shaft 41 to be synchronously rotated with the first rotating shaft 41. In particular, two rotating wheels 471 are fixed on the first rotating shaft 41, and located near the first swinging arm 45 and the second swinging arm 46, respectively. Moreover, one of the two first elastic elements 472 is sheathed around one of the two rotating wheels 471 of the first swinging arm 45, and the other first elastic element 472 is sheathed around the other rotating wheel 471 and the second swinging arm 46.

Moreover, the first swinging arm 45 further comprises a first opening 452, and the first floating mechanism 48 is disposed within the first opening 452. Moreover, the first floating mechanism 48 comprises a first sliding block 481 and a second elastic element 482. A first end 431 of the second rotating shaft 43 is penetrated through the first sliding block 481. The first sliding block 481 is movable within the first opening 452, so that the second rotating shaft 43 may be moved toward the first rotating shaft 41 or away from the first rotating shaft 41. The second elastic element 482 is sheathed around the first sliding block 481 and a first inner wall 453 of the first opening 452 for providing a supporting force to the first sliding block 481.

Moreover, the second swinging arm 46 further comprises a second opening 461, and the second floating mechanism 49 is disposed within the second opening 461. Moreover, the second floating mechanism 49 comprises a second sliding block 491 and a third elastic element 492. A second end 432 of the second rotating shaft 43 is penetrated through the second sliding block 491. The second sliding block 491 is movable within the second opening 461, so that the second rotating shaft 43 may be moved toward the first rotating shaft 41 or away from the first rotating shaft 41. The third elastic element 492 is sheathed around the second sliding block 491 and a second inner wall 462 of the second opening 461 for providing a supporting force to the second sliding block 491.

Figure 7:
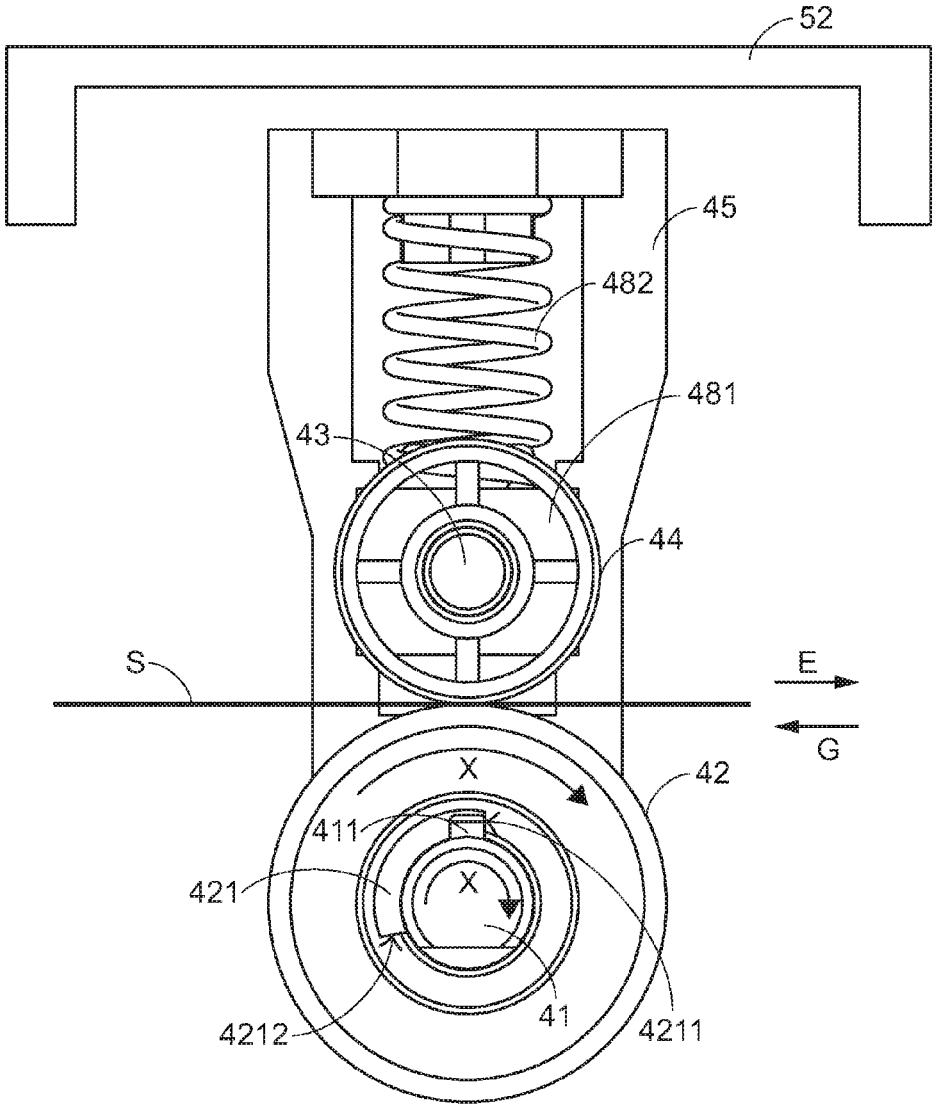
FIG. 7 schematically illustrates a first action of the inverting roller device according to the first embodiment of the present invention.
Figure 8:
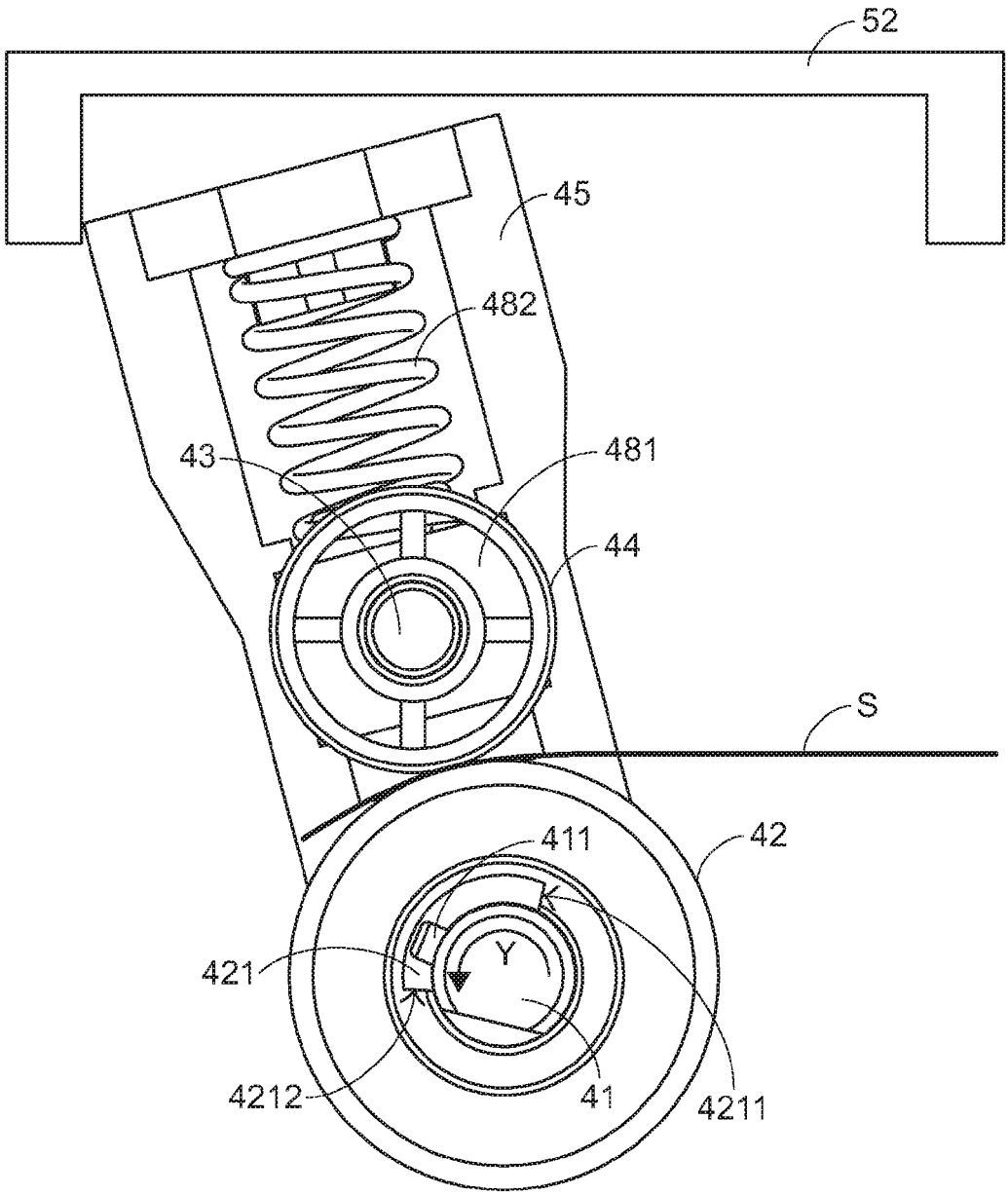
FIG. 8 schematically illustrates a second action of the inverting roller device according to the first embodiment of the present invention.
Figure 9:
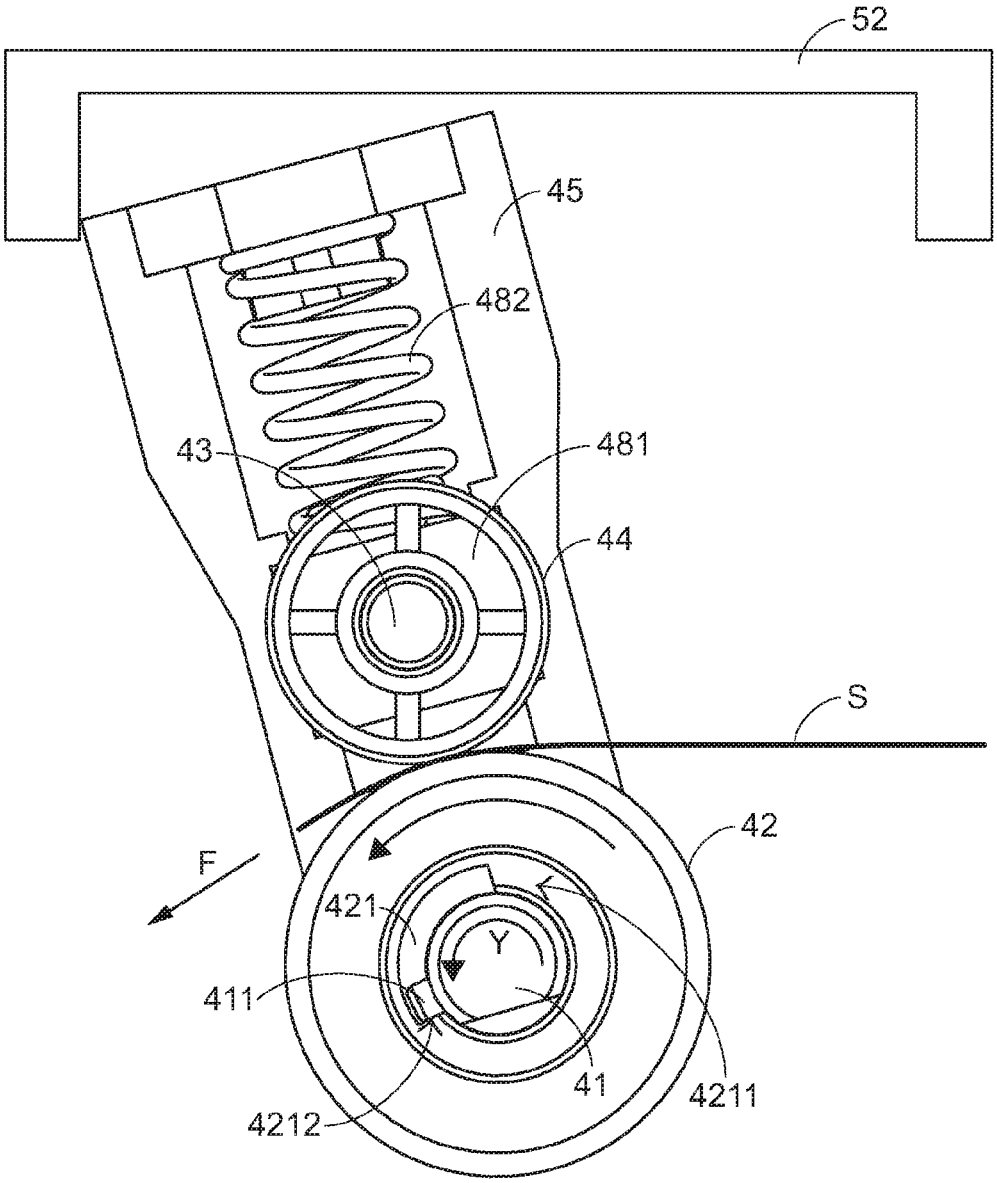
FIG. 9 schematically illustrates a third action of the inverting roller device according to the first embodiment of the present invention.
Figure 10:
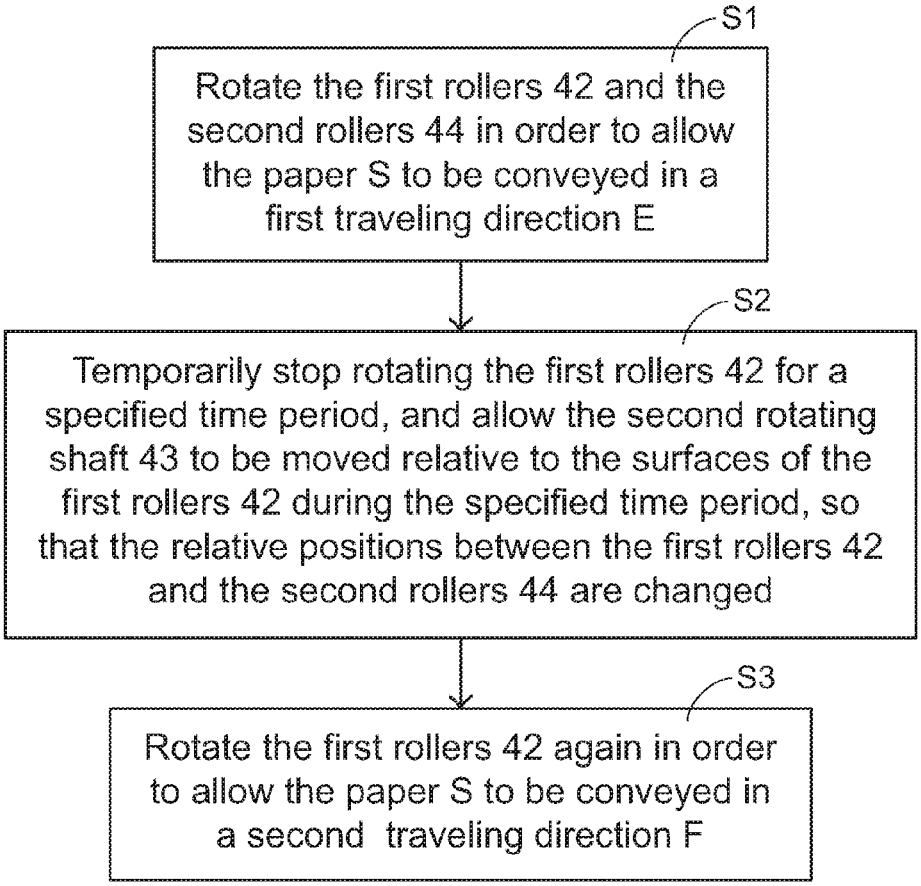
FIG. 10 is a flowchart illustrating a method of using an inverting roller device to switch a conveying path of a paper according to an embodiment of the present invention.

Hereinafter, the operations of the inverting roller device 4 will be illustrated with reference to FIGS. 7-10. FIG. 7 schematically illustrates a first action of the inverting roller device according to the first embodiment of the present invention. FIG. 8 schematically illustrates a second action of the inverting roller device according to the first embodiment of the present invention. FIG. 9 schematically illustrates a third action of the inverting roller device according to the first embodiment of the present invention. FIG. 10 is a flowchart illustrating a method of using an inverting roller device to switch a conveying path of a paper according to an embodiment of the present invention.

The inverting roller device 4 may be applied to an image forming apparatus to switch the conveying path of the paper. A method of using the inverting roller device 4 to switch the conveying path of the paper will be described in FIG. 10. Firstly, as shown in FIG. 7, the first rotating shaft 41 is positively driven to be moved in a first rotating direction X. Consequently, two first sidewalls 4211 of the two notches 421 of the two first rollers 42 are respectively pushed by the two protrusion parts 411 of the first rotating shaft 41, the two first rollers 42 are synchronously rotated with the first rotating shaft 41, and the two second rollers 44 are driven to be correspondingly rotated. Upon rotation of the two first rollers 42 and the two second rollers 44, a paper S is transported across the region between the two first rollers 42 and the two second rollers 44, and the paper S is moved in a first traveling direction E (Step S1). Meanwhile, since the first auxiliary rollers 50 and the second auxiliary rollers 51 are pushed by the paper S, the first auxiliary rollers 50 and the second auxiliary rollers 51 are synchronously rotated with the two first rollers 42. Under this circumstance, the paper S can be conveyed more smoothly, and the possibility of upturning the paper S from non-uniform force distribution will be minimized.

It is noted that the distance between each of the two first rollers 42 and the corresponding two second rollers 44 changes with the thickness of the paper S. As mentioned above, the first end 431 and the second end 432 of the second rotating shaft 43 are penetrated through the first floating mechanism 48 and the second floating mechanism 49, respectively. Moreover, the first floating mechanism 48 and the second floating mechanism 49 are movable within the first opening 452 and the second opening 461, respectively. Consequently, in response to movement of the first sliding block 481 and the second sliding block 491, the distance between the second rotating shaft 43 and the first rotating shaft 41 is correspondingly changed. Moreover, the second elastic element 482 and the third elastic element 492 are used for providing supporting forces to the first sliding block 481 and the second sliding block 491, respectively. Regardless of how the position of the second rotating shaft 43 is changed, the paper S is tightly clamped and conveyed by the two first rollers 42 and the two second rollers 44 in response to the supporting forces.

Next, as shown in FIG. 8, the first rotating shaft 41 is switched from the positively-driven state to a reversely-driven state, and thus the first rotating shaft 41 is moved in a second rotating direction Y. As the first rotating shaft 41 is rotated in the second rotating direction Y, the two protrusion parts 411 are separated from the two first sidewalls 4211 of the two notches 421 and moved toward two second sidewalls 4212 of the two notches 421. Since the two first rollers 42 are not pushed by the two protrusion parts 411 of the first rotating shaft 41, the rotations of two first rollers 42 are temporarily stopped for a specified time period (Step S2). During the rotations of two first rollers 42 are stopped, the paper S is temporarily stayed between the two first rollers 42 and the two second rollers 44.

Moreover, when the first rotating shaft 41 is switched from the positively-driven state to the reversely-driven state and the first rotating shaft 41 is moved in the second rotating direction Y, the first elastic element 472 is driven by the rotating wheel 471 to be synchronously rotated in the second rotating direction Y. Consequently, the first swinging arm 45 is driven by the first elastic element 472 to be rotated in the second rotating direction Y. Under this circumstance, the second rotating shaft 43 and the two second rollers 44 are driven by the first swinging arm 45 to be moved relative to the surfaces of the two first rollers 42, and thus the relative positions between the two first rollers 42 and the two second rollers 44 are correspondingly changed (Step S2). Moreover, as the second rotating shaft 43 is moved, the second swinging arm 46 is driven to be synchronously rotated with the first swinging arm 45. Consequently, the two ends of the second rotating shaft 43 are synchronously moved.

In this embodiment, the inverting roller device 4 further comprises a position-limiting mechanism 52. The position-limiting mechanism 52 is located beside the first swinging arm 45 for limiting the movable range of the first swinging arm 45. When the first swinging arm 45 fails to be further rotated, the dragging force exerted on the first swinging arm 45 is higher than the internal stress between the first swinging arm 45 and the first elastic element 472. Under this circumstance, the first elastic element 472 no longer drives the rotation of the first swinging arm 45. Consequently, the rotating wheel 471 and the first rotating shaft 41 are continuously rotated, but the first swinging arm 45 is no longer rotated.

When the first swinging arm 45 is moved to a fixed position, the angle of the paper S is changed (see FIG. 8). Then, as the first rotating shaft 41 is continuously rotated in the second rotating direction Y, the two protrusion parts 411 of the first rotating shaft 41 are contacted with the two second sidewalls 4212 of the two notches 421, respectively (see FIG. 9). Then, upon synchronous rotations of the two first rollers 42 and the first rotating shaft 41, the paper S is moved in a second traveling direction F (Step S3).

Please refer to FIG. 7 again. If the relative positions between the two first rollers 42 and the two second rollers 44 are not changed, when the first rotating shaft 41 is rotated in the second rotating direction Y, the paper S is moved in a third traveling direction G. The third traveling direction G is reverse to the first traveling direction E. Under this circumstance, the paper S fails to be moved in the second traveling direction F. In other words, after the relative positions between the two first rollers 42 and the two second rollers 44 are changed, the conveying path of the paper S will be changed.

In accordance with a second embodiment of the present invention, an inverting roller device 6 (see FIG. 11) for conveying a paper is provided. The inverting roller device 6 is used for changing a conveying path of the paper. The inverting roller device 6 may be applied to the image forming apparatus 1 of FIG. 1 to replace the first conveying roller assembly 18 and the second conveying roller assembly 20. Alternatively, the inverting roller device 6 may be applied to the image forming apparatus 3 of FIG. 2 to replace the second conveying roller assembly 33. The applications of the inverting roller device 6 are not restricted as the above described. The inverting roller device 6 may be used in the image forming apparatus to switch the conveying path of the paper. In case that the inverting roller device 6 is applied to the image forming apparatus 1 or the image forming apparatus 3, the movable stopping block 19 or 37 may be omitted, and it is not necessary to install the protruding corner 261 of the supporting plate 26 along the path A.

Figure 11:
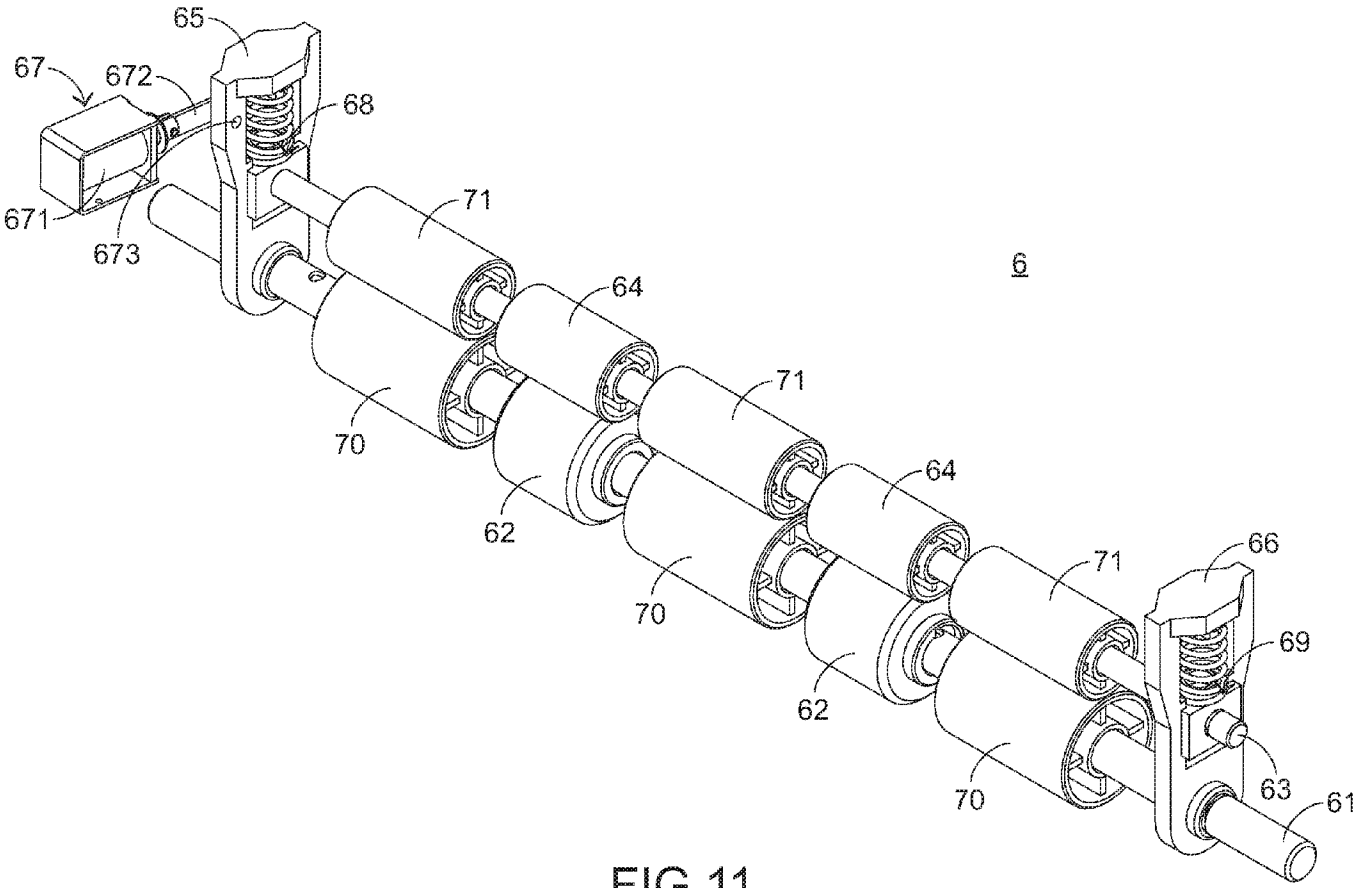
FIG. 11 is a schematic perspective view illustrating the outer appearance of an inverting roller device according to a second embodiment of the present invention.

FIG. 11 is a schematic perspective view illustrating the outer appearance of an inverting roller device according to a second embodiment of the present invention. The inverting roller device 6 comprises a first rotating shaft 61, two first rollers 62, a second rotating shaft 63, two second rollers 64, a first swinging arm 65, a second swinging arm 66, a power mechanism 67, a first floating mechanism 68, a second floating mechanism 69, three first auxiliary rollers 70, and three second auxiliary rollers 71.

In this embodiment, the power mechanism 67 is a solenoid valve comprises a coil bobbin 671, a plunger 672, and a connecting part 673. A first end of the plunger 672 is disposed within the coil bobbin 671. A second end of the plunger 672 is exposed outside the coil bobbin 671, and connected with the first swinging arm 65 through the connecting part 673. It is noted that the power mechanism 67 is not limited to the solenoid valve. Alternatively, a motor or any other power device may be used as the power mechanism 67.

In accordance with the features of the inverting roller device 6, if the first rotating shaft 61 is not driven to be rotated, the first swinging arm 65 may be driven by the power mechanism 67 to be rotated about the first rotating shaft 61. As the first swinging arm 65 is rotated, the second rotating shaft 63 and the two second rollers 64 are driven by the first swinging arm 65 to be moved relative to the surfaces of the two first rollers 62, and thus the relative positions between the two first rollers 62 and the two second rollers 64 are correspondingly changed. In comparison with the inverting roller device 4 of the first embodiment, the inverting roller device 6 of this embodiment uses the power mechanism 67 to rotate the first swinging arm 65, but the transmission mechanism 47 is not included in the inverting roller device 6. Consequently, the first swinging arm 65 is not rotated in response to the rotation of the first rotating shaft 61. Moreover, in the inverting roller device 6 of this embodiment, it is not necessary to form the protrusion parts on the first rotating shaft 61 and form the notches in the first roller 62. Regardless of whether the rotating direction of the first rotating shaft 61 is changed, the first rollers 62 are synchronously rotated with the first rotating shaft 61. The structures of the other components of the inverting roller device 6 and the assembling sequence of the inverting roller device 6 are similar to those of the first embodiment, and are not redundantly described herein.

The operations of the inverting roller device 6 will be illustrated in more details as follows. Firstly, the first rotating shaft 61 is driven to be rotated. Consequently, the two first rollers 62 are synchronously rotated with the first rotating shaft 61, and the two second rollers 64 are driven to be correspondingly rotated. Upon rotations of the two first rollers 62 and the two second rollers 64, a paper is transported across the region between the two first rollers 62 and the two second rollers 64, and the paper can be conveyed. Meanwhile, since the first auxiliary rollers 70 and the second auxiliary rollers 71 are pushed by the paper, the first auxiliary rollers 70 and the second auxiliary rollers 71 are synchronously rotated with the two first rollers 62. Under this circumstance, the paper can be conveyed more smoothly, and the possibility of upturning the paper from non-uniform force distribution will be minimized.

Then, the rotation of the first rotating shaft 61 is stopped for a specified time. Consequently, the rotation of the first rollers is temporarily stopped, and the paper is temporarily stayed between the two first rollers 62 and the two second rollers 64. Then, the plunger 672 is driven by the power mechanism 67 to be moved toward the coil bobbin 671. Consequently, the first swinging arm 65 is pulled by the plunger 672 to be rotated about the first rotating shaft 61. Under this circumstance, the second rotating shaft 63 and the two second rollers 64 are driven by the first swinging arm 65 to be moved relative to the surfaces of the two first rollers 62, and thus the relative positions between the two first rollers 62 and the two second rollers 64 are correspondingly changed. Similarly, the plunger 672 may be driven by the power mechanism 67 to be moved away from the coil bobbin 671. Consequently, the first swinging arm 65 is pushed by the plunger 672. Under this circumstance, the relative positions between the two first rollers 62 and the two second rollers 64 are correspondingly changed. Moreover, as the second rotating shaft 63 is moved, the second swinging arm 66 is driven to be synchronously rotated with the first swinging arm 65. Consequently, the two ends of the second rotating shaft 63 are synchronously moved. When the first swinging arm 65 is moved to a fixed position, the angle of the paper is changed. Then, as the first rotating shaft 61 is driven to rotate the two first rollers 62 again, the conveying path of the paper is changed.

It is noted that the movable range of the plunger 672 is confined by the coil bobbin 671. That is, due to the confinement of the coil bobbin 671, the plunger 672 can only be moved toward or away from the coil bobbin 671 to a specified position. When the plunger 672 is moved to the specified position, the plunger 672 fails to be moved, and thus the first swinging arm 65 is no longer rotated. Since the movable range of the first swinging arm 65 is controlled by the power mechanism 67, it is not necessary to install the position-limiting mechanism 52 of the first embodiment.

From the above descriptions, the present invention provides the inverting roller device. Since the first switching arm is pivotally disposed on the first rotating shaft, the second rotating shaft and the second roller can be moved relative to the surface of the first roller. Under this circumstance, the relative position between the first roller and the second roller is changed, and the conveying path of the paper is correspondingly changed. In case that the inverting roller device of the present invention is applied to an image forming apparatus, the conveying path of the paper can be changed without the need of installing an additional movable stopping block. Consequently, the problem of wasting the layout space will be overcome, and possibility of colliding and bending the paper during the conveying process will be minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inverting roller device for conveying a paper and changing a conveying path of said paper, said inverting roller device comprising:

a first rotating shaft comprising a protrusion part, wherein when said first rotating shaft is in a positively-driven state, said first rotating shaft is rotated in a first rotating direction, wherein when said first rotating shaft is in a reversely-driven state, said first rotating shaft is rotated in a second rotating direction;

a first roller pivotally disposed on said first rotating shaft, and comprising a notch, wherein said notch comprises a first sidewall and a second sidewall, wherein said protrusion part is accommodated within said notch;

a second rotating shaft located at a side of said first rotating shaft and arranged in parallel with said first rotating shaft;

a second roller disposed on said second rotating shaft, wherein said first roller and said second roller are contacted with each other, so that said paper is clamped and conveyed by said first roller and said second roller;

a first swinging arm pivotally disposed on a first end of said first rotating shaft and connected with a first end of said second rotating shaft, wherein as said first rotating shaft is rotated, said first swinging arm is correspondingly rotated; and a second swinging arm disposed on a second end of said first rotating shaft and connected with a second end of said second rotating shaft, wherein when said first rotating shaft is in said positively-driven state, said protrusion part is contacted with said first sidewall of said notch, so that said first roller is synchronously rotated with said first rotating shaft, wherein when said first rotating shaft is switched from said positively-driven state to said reversely-driven state, said protrusion part is separated from said first sidewall of said notch and moved toward said second sidewall of said notch, so that said first roller is not rotated temporarily and said first swinging arm is driven by said first rotating shaft to be rotated, wherein as said first swinging arm is rotated, said second rotating shaft and said second roller are moved relative to a surface of said first roller, so that a relative position between said first roller and said second roller is changed and said conveying path of said paper is correspondingly changed.

2. The inverting roller device according to claim 1, further comprising a transmission mechanism, wherein said first swinging arm is driven to be rotated by said first rotating shaft through said transmission mechanism, wherein said transmission mechanism comprises a rotating wheel and a first elastic element, wherein said rotating wheel is fixed on said first rotating shaft, and said first elastic element is sheathed around said rotating wheel and said first swinging arm.

3. The inverting roller device according to claim 1, further comprising a first floating mechanism, which is disposed within a first opening of said first swinging arm for allowing said paper to be tightly clamped by said first roller and said second roller, wherein said first floating mechanism comprises a first sliding block and a second elastic element, wherein said first end of said second rotating shaft is penetrated through said first sliding block, and said second elastic element is sheathed around a first inner wall of said first opening and said first sliding block.

4. The inverting roller device according to claim 1, further comprising a position-limiting mechanism, wherein said position-limiting mechanism is located beside said first swinging arm for limiting a movable range of said first swinging arm.

5. The inverting roller device according to claim 1, further comprising a second floating mechanism, which is disposed within a second opening of said second swinging arm for allowing said paper to be tightly clamped by said first roller and said second roller, wherein said second floating mechanism comprises a second sliding block and a third elastic element, wherein said second end of said second rotating shaft is penetrated through said second sliding block, and said third elastic element is connected with a second inner wall of said second opening and said second sliding block.

6. The inverting roller device according to claim 1, further comprising a transmission mechanism, wherein said second swinging arm is driven to be rotated by said first rotating shaft through said transmission mechanism, wherein said transmission mechanism comprises a rotating wheel and a first elastic element, wherein said rotating wheel is fixed on said first rotating shaft, and said first elastic element is sheathed around said rotating wheel and said second swinging arm.

7. The inverting roller device according to claim 1, further comprising a first auxiliary roller and a second auxiliary roller, wherein said first rotating shaft is penetrated through said first auxiliary roller, said second rotating shaft is penetrated through said second auxiliary roller, and said first auxiliary roller and said second auxiliary roller are aligned with each other.

8. A method for changing a conveying path of a paper, said paper being clamped between a first roller and a second roller and conveyed by said first roller and said second roller, a first rotating shaft being penetrated through said first roller, a second rotating shaft being penetrated through said second roller, said method comprising steps of:

rotating said first roller and said second roller to allow said paper to be conveyed in a first traveling direction;

stopping rotating said first roller for a specified time period, and allowing said second rotating shaft to be moved relative to a surface of said first roller during said specified time period, thereby changing a relative position between said first roller and said second roller; and rotating said first roller again to allow said paper to be conveyed in a second traveling direction.

* * * * *